United States Patent [19]

Hueschen et al.

[11] 4,052,640

[45] Oct. 4, 1977

[54] ANODES FOR ROTARY ANODE X-RAY TUBES

[75] Inventors: Robert E. Hueschen, Hales Corners, Wis.; John H. Port, Solon, Ohio

[73] Assignee: General Electric Company, Schenectady, N.Y.

[21] Appl. No.: 697,849

[22] Filed: June 21, 1976

[51] Int. Cl.[2] ..... H01J 35/08

[52] U.S. Cl. ..... 313/330; 313/60

[58] Field of Search ..... 313/330, 56, 60

[56] References Cited

U.S. PATENT DOCUMENTS

| | | | |
|---|---|---|---|
| 3,790,838 | 2/1974 | Baum | 313/330 |
| 3,836,807 | 9/1974 | Schreiner et al. | 313/330 |
| 3,851,204 | 11/1974 | Rollfinke | 313/330 |
| 4,005,322 | 1/1977 | Koller | 313/330 |

*Primary Examiner*—Saxfield Chatmon, Jr.
*Attorney, Agent, or Firm*—Ralph G. Hohenfeldt

[57] ABSTRACT

Anodes for rotary anode x-ray tubes have cross sectional configurations which aid in mitigating warpage due to thermal stress.

5 Claims, 5 Drawing Figures

ANODES FOR ROTARY ANODE X-RAY TUBES

BACKGROUND OF THE INVENTION

This invention is concerned primarily with mitigating warpage of x-ray targets or anodes in rotary anode x-ray tubes.

Conventional targets for rotating anode x-ray tubes are essentially discs which on their front face have an annular region, constituting a focal spot track, beveled rearwardly and concentric with the axis of rotation. Usually the rear surface of the targets is concave and the cross sectional thickness is substantially uniform. The configuration has been considered a reasonably good compromise of several conflicting design objectives. For instance, the rear surface concavity economizes material and reduces the mass and, hence, the moment of inertia of the target so it may be accelerated rapidly to maximum rotational speed. But this reduction in material and the distribution of the material results in substantially reduced thermal capacity and substantially higher internal stress which sometimes cause the target to fracture and frequently causes it to undergo permanent warpage after an undesirably small number of thermal cycles. Warpage is manifested by a change in the focal track surface angle which results in part of the x-ray beam being cut off so it will not properly cover the film or other x-ray image recording medium. Targets which are thinner than customary would have insufficient thermal capacity for most x-ray diagnostic procedures.

As is well known, early x-ray tube targets were made of essentially pure tungsten. Eventually x-ray technics were adopted that called for high electron beam currents and voltages and high duty cycles which produced rapid deterioration of the focal spot track because of an inability of the target to conduct the intense heat away rapidly enough from the focal spot. The general remedy was to increase rotational speed of the targets up to as high as 10,000 rpm. When a radiologist is fluoroscoping, the x-ray tube is operated at low power and low target rotational speed. When something of interest is observed for which a radiograph is desired, the target must be stepped up to maximum rotational speed in the least possible time for a high power exposure and, hence, it is desirable for the target to have low inertia.

One way to reduce inertia is by making the body of the target of molybdenum which has lower density than tungsten but does not produce x-radiation as efficiently as tungsten. Hence, it became the common practice to overlay the focal spot track with a higher density alloy of tungsten and up to about 10% of rhenium which alloy has known desirable properties. In some cases as much as 35% of scarce and expensive rhenium is used. Moreover, the bimetal action between the tungsten-rhenium surface layer and the molybdenum substrate is believed to be a major factor in anode target warpage. Molybdenum has a coefficient of expansion about 12% greater than tungsten and therefore causes internal stresses to be developed that then to straighten out the target, that is, the target warps such that the beveled targed focal track surface becomes curved and deflects forwardly toward the electron beam source. Another major factor contributing to warpage is the circumferential or hoop stress developed at higher temperatures and speeds in targets having conventional shape.

Attempts have been made to reduce target warpage by reducing bimetal action. One attempt involved including in the molybdenum substrate as much as 5% tungsten. Another attempt involved adding a tungsten interlayer inside of the molybdenum substrate beneath the tungsten-rhenium layer near the rear surface of the target to counteract the bimetal action of the tungsten-rhenium surface layer and the substrate due to their differences in thermal expansion. These approaches have a number of disadvantages: (1) the addition of the tungsten layer is expensive and difficult to make uniform, (2) any nonuniformity of the layer causes serious balancing problems, (3) the more brittle nature of tungsten makes the target more prone to fracture, and (4) the addition of the tungsten, particularly at the outer diameter of the target, increases the moment of inertia of the target markedly and thereby increases the time for the rotating anode to accelerate to high speed such as 10,000 rpm.

SUMMARY OF THE INVENTION

Objects of the present invention are to mitigate target warpage which occurs during useage, to decrease the anode acceleration time, to minimize cracking by optimizing target design while at the same time increasing or optimizing the heat storage capacity of the target, and, to decrease internal stresses.

Briefly stated, in the new target configurations, stress is reduced by decreasing the molybdenum or other substrate metal thickness under the outer diameter focal track area of the target. Reduced stress in this region results in reduced target warpage. The volume of metal that is eliminated from behind the focal spot area or focal track is placed in the center portion of the target to strengthen it and provide adequate heat storage or thermal capacity. A principle advantage of having the mass of the target concentrated near its axis of rotation is that its moment of inertia is reduced so its acceleration time is decreased.

How the foregoing and other more specific objects of the invention are achieved will be evident in the ensuing description of illustrative embodiments of the invention which are set forth in reference to the drawing.

DESCRIPTION OF A PREFERRED EMBODIMENT

Figure 1:
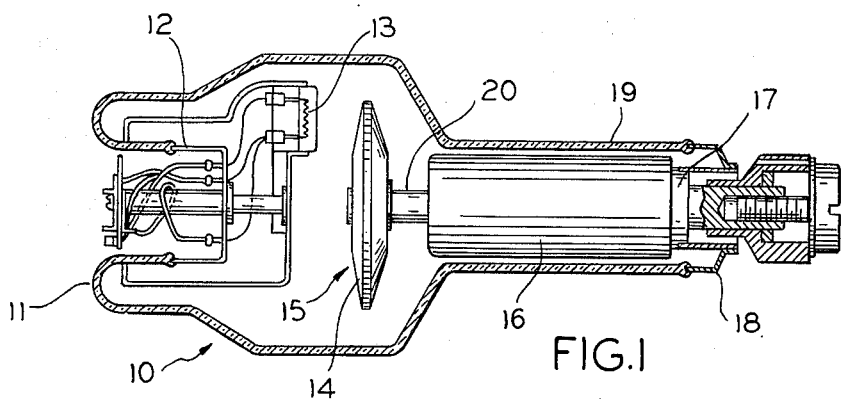
FIG. 1 is a cross-sectional side elevation of an illustrative x-ray tube in which the new targets may be used.

FIG. 1 shows one type of rotating anode x-ray tube in which the new anode targets may be used. The tube comprises a glass envelope 10 having a re-entrant end 11 to which a cathode supporting structure 12 is sealed. The electron beam for generating x-rays is emitted from a thermionic filament 13. The target on which the beam impinges for producing x-rays is generally designated by the reference number 14. The target has a rearwardly beveled circular front face 15 which contains the focal spot track on which the electron beam impinges. Target 14 is on a rotor 16 which is journaled on a stationary member 17 that is sealed with a metal ferrule 18 to the end of the glass envelope. Rotor 16 is adapted to be driven in a well-known manner by a magnetic field generated by coils, not shown, positioned exteriorly of the tubular glass portion 19.

Figure 2:
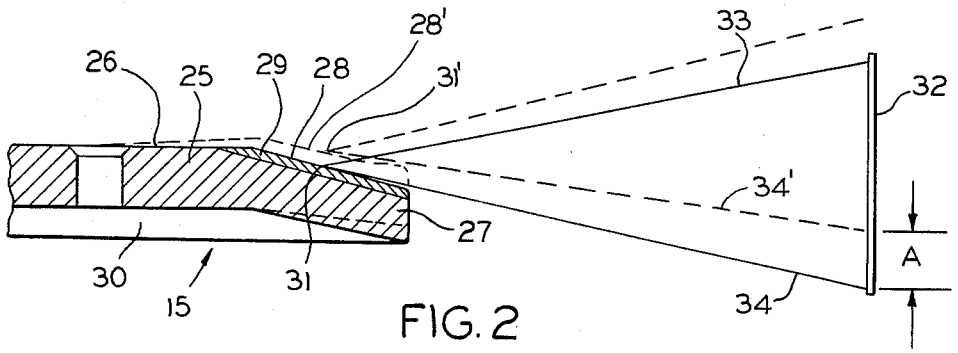
FIG. 2 shows a portion of a prior art target where the shape it assumes when warped is shown in dashed lines and the target is associated with a diagram for illustrating the effect of target warpage on focal spot shift.

A fragment of a typical prior art target is shown in FIG. 2 for the purpose of providing background information and to illustrate the effect of focal spot shift due to target warpage. In FIG. 2, the principal portion of the target body or substrate is marked 25. The substrate is typically a low density and high specific heat material compared to tungsten such as molybdenum and molybdenum alloyed with other material. It has a planar front surface 26 and a beveled focal spot track surface 28. The track surface has a tungsten or tungsten alloy surface layer 29 which is generally between 0.03 and 0.06 inch thick and often comprised of up to about 10% rhenium with the remainder tungsten. The rearwardly angulated edge region 27 of the target body results in a rear recess or cavity 30 being formed in the target and, one may see, that the target substrate 25 has substantially uniform thickness throughout its radius.

The normal rear boundary of the x-ray beam from an unwarped target lies along the line marked 34. An x-ray sensitive surface typified by a film 32 is in spaced relationship to the focal spot. Before any target warpage has occurred, one may see that the film 32 falls within the cone of radiation defined by the solid line boundary rays 33 and 34. The position of the focal spot track surface when the target has undergone warpage is suggested in an exaggerated manner by the curved dashed line marked 28'. Now radiation which could formerly follow the boundary 34 is cut off by interfering metal in the warped target surface as shown by boundary line 34'. Thus, a region marked A has its radiation eclipsed by intervening target material after warpage and part of the x-ray image of an object between the focal spot and the film is undesirably cut off. Thus, it is imperative that target warpage be kept to a minimum to provide optimum focal spot size and film coverage.

Figure 3:
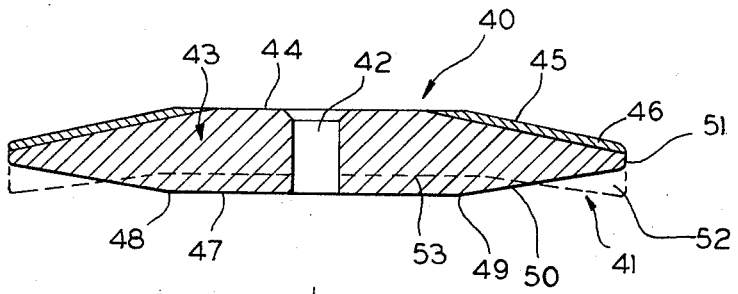
FIGS. 3 and 4 are cross-sections of anode targets made in accordance with the invention.

Refer now to FIG. 3 which shows a cross section of a new target that is characterized by minimum warpage after a large number of high energy x-ray exposures. The target which is configured in accordance with one illustration of the invention is shown in solid lines and is designated generally by the reference numeral 40. A typical prior art target which is in dashed outline marked 41 is also superimposed on this view.

In FIG. 3, the new target, which is represented in solid lines, has a central hole 42 for mounting it on a spindle of a rotating anode x-ray tube. The principal part of the body or substrate of the target is marked 43 and is preferably essentially pure molybdenum or molybdenum alloys. The front face of the target is substantially similar to some prior art targets in that it has an unbeveled central circular surface 44 that is continuous with a radially displaced rearwardly beveled or angulated focal spot track region 45. The annular beveled region has a surface layer 46 which is typically composed of tungsten or tungsten alloys, frequently with 1% up to about 10% rhenium. The central region at the rear of the target is marked 47 and is planar or unbeveled and parallel with front face region 44 in this example although this region may be curved if desired. The central region of the target has substantially constant thickness in the axial direction between front and rear unbeveled surfaces 44 and 47 over a diameter defined between points marked 48 and 49. The unbeveled surface diameter is at least equal to 50% of the overall target disc diameter. In accordance with the invention, the rear face of target 40 has an annular region near its periphery forwardly beveled. This region is marked 50 and, in this particular design, extends from the point 49 to the outer periphery 51 of the target.

Comparing the new target 40 which is shown in solid lines with the prior art target 41 which is shown in dashed lines in FIG. 3, one may see that an annular volume having a triangularly shaped cross section 52 on the old target is, in effect, transferred to the midregion of the new target to increase its thickness in the midregion with a volume of metal lying between the radially extending dashed line 53 and the unbeveled rear surface 47.

The FIG. 3 embodiment of the invention is illustrative of the concept of decreasing stress exerted by the molybdenum substrate 43 by decreasing the molybdenum volume under the outer diameter focal track area of the target. This reduction of substrate volume decreases the force which can be exerted in a radial or circumferential direction. The reduction of substrate volume immediately beneath the focal spot track results in that volume operating at higher temperatures which, in turn, has the effect of decreasing the circumferential or hoop stress in that volume which would tend to deform the target. The efficacy of the various mechanisms for relieving stress in metals, such as mobility of dislocations and slip planes, are all enhanced at higher operating temperatures. As indicated above, this volume of metal is placed in the center region of the target to strengthen it. Increasing the thickness of the center region of the target where thermal gradients are lower is one factor contributing to decreased warpage. As any cross sectional thickness is increased, the unit stress is reduced or, in other words, a thicker central region can resist higher bending moments. In accordance with the invention, the ratio between the maximum diameter of the target and the thickness of the target in the central region should be in the range of 4 to 1 and 10 to 1. Smaller diameter-to-thickness ratios are permissible but those substantially below 4.0 could result in relatively high moments of inertia and undesirably low acceleration rates for the rotating target. The angle of the beveled surface 50 in FIG. 3 relative to a plane to which the axis of the target is perpendicular may be typically in the range of about 5° to 35° for long rear bevels as in the FIG. 3 embodiment. Generally, as the front bevel angle of the target surface 46 is increased, the rear angle of the surface 50 will be decreased to maintain the desired target volume and moment of inertia.

Figure 5:
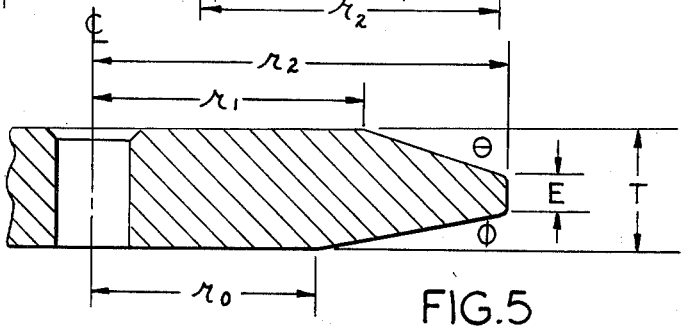
FIG. 5 is a fragment of a target that identifies angles and dimensions which are used in a design equation (1) set forth hereinafter.

More specifically, in reference to FIG. 5, the relationship between the front beveled surface angle, $\theta$, and the rear beveled surface angle, $\phi$, for an anode having optimized moment of inertia and resistance to warpage, in accordance with the principles of this invention, is as defined by equation (1) below:

$$\phi = \arctan\left[\frac{W - (r_2 - r_1)\tan\theta}{r_2 - r_0}\right] \quad (1)$$

where:

$r_0$ is the rear unbeveled surface radius;

$r_1$ is the front unbeveled surface radius;

$r_2$ is the total anode radius; and $W$ = T-E where T is the total thickness of the anode (selected for a desired heat storage capacity) and E is the thickness of the peripheral edge of the anode;

$r_1$ is then determined by $r_2$ and the actual length of the focal spot.

$r_0$ is selected to be $0.5r_1$ to $1.5r_1$

Values of $r_0$ near the lower end of the range defined above generally result in lower moments of inertia than result from values near the higher end of the range.

Figure 4:
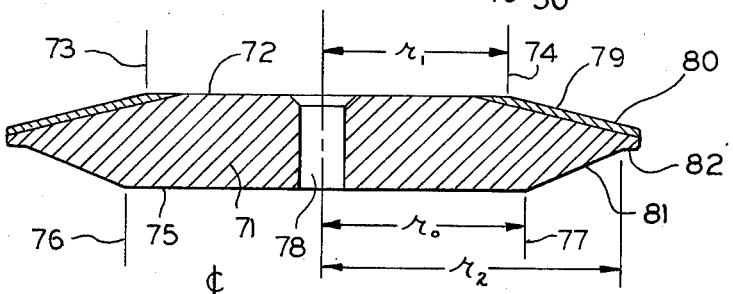

$E$ may be any value greater than 0.1 inch (2.5mm) consistent with good high voltage electrode design practices as exemplified by the radiused edges shown in FIGS. 3 and 4.

By way of example, in a commercial embodiment of a four inch diameter target with a two inch central unbeveled region on the back of the target with a front surface angle $\theta$ of 11°, the rear surface angle $\phi$ is about 8.5° and where the front angle is 15° the rear angle is about 6.0°. In any case, a minimum thickness in the area under the focal track of about 0.10 inches must be maintained to prevent radial fracturing through this region as well as to provide sufficient material under the focal spot track to maintain the mechanical integrity of the target at high operating temperatures.

The increased thickness of the central portion of targets made in accordance with the present invention, resulting from redistribution of substrate metal as compared with its conventional distribution is a major factor in mitigating the type of warpage which results from deformation of the central region of the target. A theoretical analysis of a target in which there exists a decreasing temperature gradient from the front to the rear reveals that the front of the target will be in compression and the rear of the target in tension. The relatively large volume of cooler material toward the rear of the target is substantially more rigid than the hotter, lower yield strength material near the front track surface. The result is that the yield strength of the hot material is exceeded and plastic deformation occurs. Upon subsequent cooling of the target, stresses are generated within the target in such manner as to deform prior art targets toward the front surface as illustrated in FIG. 2. Making the target with a thicker center section, in accordance with the present invention, strengthens the center section so it resists deformation during the cooling part of the target operating cycle.

In addition to the warpage of prior art type targets, warpage also occurs in the beveled portion of the target where high thermal gradients are present in the volume immediately beneath the focal spot track.

The driving mechanism for deforming the beveled portion of prior art targets is the same mechanism which deforms the central portion of the targets as discussed above. The present invention mitigates the second type of deformation through the use of the rear beveled surface which results in a volume in the beveled portion in which the internal stresses created by temperature gradients are redistributed in such a manner as to reduce the bending moment generated within that volume.

Another embodiment of a target using the principles set forth above is illustrated in FIG. 4. In this case the substrate or target body is marked 71 and is preferably comprised of pure molybdenum. The body has an unbeveled circular front face 72 extending over a diameter bounded by the marks 73 and 74. The rear face 75 is also unbeveled and circular with a diameter defined between the markers 76 and 77. The target has a central hole 78 for mounting it on a rotating spindle such as 20 in FIG. 1. The front beveled surface 79 constituting the focal track region of the target is beveled rearwardly generally between 6 and 17 degress by various manufacturers. The focal track has a tungsten-rhenium or other tungsten alloy surface layer 80. The periphery 81 of the target body is beveled forwardly at angles defined in equation (1) in this example except that $r_2$ of equation (1) is defined as the radius to the start of shoulder 82 as shown in FIG. 4 and metal that would otherwise occupy the beveled region is transferred to the central region. The heavy central region between surfaces 72 and 75 results in low internal stress and, hence, reduced tendency to warp when heated. The bevel 81 terminates in a radially extending shoulder 82. The radially extending shoulder 82 enables the target diameter to be kept large without adding substantial mass since the section of metal at radii beyond the shoulder 82 is relatively thin. The purpose of the shoulder 82 is to minimize passage of stray electrons axially of the target when it is in the x-ray tube envelope. Thus, the shielding effect of a large target is obtained but without the mass at the periphery of the target as is the case in prior art target designs. The ratio of maximum target diameter to central region thickness given with respect to the FIG. 3 embodiment also apply to the FIG. 4 embodiment.

A general observation about the targets depicted in FIGS. 3 and 4 is that removal of material from the back of the target under the electron focal track region will decrease warpage but total symmetry in relation to the front of the target is not essential. In all cases material has been removed from the back of the target at angles of from 5° to 35° for design shown in FIG. 3 and 30° to 45° for design shown in FIG. 4 and in all cases target warpage was reduced in tests that compared the new targets with prior art targets under severe loading conditions. In all of the embodiments, a minimum thickness in area under the focal track of no less than 0.10 inches is maintained to prevent possible radial fracturing of this region as well as to provide sufficient material under the focal track region to lower bulk target temperatures and prevent extremely steep thermal gradients.

We claim:

1. An anode for use in a rotary anode x-ray tube, comprising:

a disc having an axis of rotation and comprised of a first metallic material, said disc having a front and a rear face and said first metallic material being of uniform composition and being uninterrupted from said front to said rear face, said front face having a substantially unbeveled central region circumjacent said axis and an adjacent annular region which is beveled rearwardly at an acute angle relative to a plane to which said axis of rotation is perpendicular, said rearwardly beveled annular region having a surface layer comprised of a second metallic material having a different coefficient of thermal expansion than said first metallic material, said surface layer providing a focal spot surface on which the electron beam of an x-ray tube impinges to produce x-radiation an incident of which is to produce a high temperature gradient in said disc in the region adjacent said front face, said rear face having a substantially unbeveled central region circumjacent said axis and an adjacent annular region which is beveled forwardly at an acute angle relative to a plane to which said axis is perpendicular, the configuration of said anode for minimizing distortion of said disc due to cyclical occurrence of said high temperature gradient being defined by the equation $$\phi = \arc\tan\left[\frac{W - (r_2 - r_1)\tan\theta}{r_2 - r_0}\right]$$

where:

$r_0$ is the rear unbeveled surface radius;

$r_1$ is the front unbeveled surface radius;

$r_2$ is the total anode radius;

$W$ = T-E where T is the total thickness of the anode and E is the thickness of the peripheral edge of the anode;

$\theta$ is the angle between the front rearwardly beveled surface and a plane to which said axis of rotation is perpendicular; and $\phi$ is the angle between the rear forwardly beveled surface and a plane to which said axis of rotation is perpendicular.

2. The anode as defined in claim 1 wherein the thickness T is selected to result in the anode having a predetermined heat storage capacity.

3. The anode as defined in claim 1 wherein $r_0$ is selected to be in the range of $0.5r_1$ to $1.5r_1$.

4. The anode as in claim 1 wherein said first metallic material is one selected from the class consisting of molybdenum and alloys of molybdenum and tungsten.

5. The anode as in claim 4 wherein said second metallic material comprises 1% to 10% of rhenium.

* * * * *